US005826340A

United States Patent [19]

Hull

[11] Patent Number: 5,826,340

[45] Date of Patent: Oct. 27, 1998

[54] TWO-PIECE HANDLE AND METHOD OF ASSEMBLY

[75] Inventor: Stephen J. Hull, La Jolla, Calif.

[73] Assignee: Buck Knives, El Cajon, Calif.

[21] Appl. No.: 662,303

[22] Filed: Jun. 12, 1996

Related U.S. Application Data

[63] Continuation of Ser. No. 373,755, Jan. 17, 1995, abandoned.

[51] Int. Cl.[6] ..... B26B 1/04

[52] U.S. Cl. ..... 30/161; 30/160

[58] Field of Search ..... 30/158–161; 7/118–120; D22/118

[56] References Cited

U.S. PATENT DOCUMENTS

| | | | |
|---|---|---|---|
| 313,414 | 3/1885 | Freund | 7/118 X |
| 2,343,175 | 7/1944 | Evinger . | |
| 4,570,341 | 2/1986 | Konneker | 30/161 |
| 4,776,094 | 10/1988 | Glesser | 7/119 X |
| 4,811,486 | 3/1989 | Cunningham | 30/161 |
| 4,918,820 | 4/1990 | Korb et al. | 30/161 |

OTHER PUBLICATIONS

5 Photographs of Two–Piece Knife Handle Manufactured by Gerber Legendary Blades; 14200 S.W. 72nd Ave., Portland, OR.

Buck Knives 1994 Catalog (CL35M194); p. 6.

*Primary Examiner*—Douglas D. Watts

*Attorney, Agent, or Firm*—Jones, Tuller & Cooper, P.C.

[57] ABSTRACT

A two-piece handle is provided having a male handle half and a female handle half, each of which may be formed separately by molding, machining, or other processes. The male handle half includes a projection near the rear of the handle, and has a first hole in the projection for receiving a leaf spring rod. The female handle half has an integral spring holder which includes a recess for receiving the projection of the male handle half. The spring holder has a second hole for receiving a leaf spring rod through it which intersects with the recess. When the projection of the male half is fitted into the recess of the female half, the first hole and the second hole line up sufficiently to enable the insertion of the leaf spring rod. When the leaf spring rod has been inserted, it aids in retaining the male handle half in an assembled state with the female handle half, while also serving a spring for the blade locking mechanism.

8 Claims, 3 Drawing Sheets

TWO-PIECE HANDLE AND METHOD OF ASSEMBLY

This application is a continuation of application Ser. No. 08/373,755, filed Jan. 17, 1995 now abandoned.

FIELD OF THE INVENTION

The present invention is directed generally to a novel two-piece handle and the method of assembling the handle. More particularly, the present invention is directed to a two-piece handle having two halves which fit together to encase a folding knife blade or similar tool. Most specifically, the present invention is directed to a two-piece knife handle having two halves which interfit, and which are held together, at least in part, by a rod which also serves as a leaf spring for biasing the rocker of a folding knife.

DESCRIPTION OF THE PRIOR ART

Folding knives, such as conventional pocket knives, have been known for many years. These knives typically have a retractable or folding blade which pivots or otherwise extends from a storage position to an open operating position. Once in the open position, a means is usually provided for retaining the knife in the open position so that the blade will not fold back upon the user's hand while the blade is being used.

A conventional arrangement for locking a blade in the open position uses a pivotally mounted bar known as a rocker. The rocker is sandwiched between two halves of a knife handle, and has a projecting tooth at its forward end which engages with a notch in the knife blade for locking the blade in the open position. The rocker is typically spring-biased by a leaf spring. The leaf spring is usually a rectangular or round rod of spring steel contained within the handle by means of a spring holder. The spring bears against the rear end of the rocker, forcing the tooth on the front end of the rocker into the notch in the blade. The blade is released from the locked position by depressing the rear end of the rocker against the force of the spring, thereby lifting the projecting tooth on the forward end of the rocker out of the notch in the blade. The blade may then be pivoted into the handle to the closed or folded position.

The force of the leaf spring against the rocker also serves to keep the blade in the closed position, although the blade typically is not locked in the closed position. Instead, the base of the blade is cammed so that as the blade is rotated from the closed to the open position, the forward end of the rocker is raised, allowing the blade to rotate open. This, in turn, requires increased force because the leaf spring must be depressed as the forward end of the rocker is raised. Thus, the leaf spring and rocker play an important role in conventional folding knives, being used to both lock the knife blade in the open position, and to keep the blade in the handle in the closed position.

A conventional folding knife may be constructed with a two-piece handle having a left handle half and a right handle half. The handle halves are usually mirror images of each other, and the knife is assembled by sandwiching metal components between the two handle halves. These components usually include a spring holder, a leaf spring, a rocker, and a knife blade. The assembly is typically rivetted together by a minimum of four rivets. One rivet is located at the front of the handle, through the pivot point of the knife blade; one rivet is located near the middle of the handle, through the pivot point of the rocker; and two rivets are located near the rear of the handle, through the spring holder. Alternative methods of assembly such as welding, brazing, adhesive bonding, or other means may also be used in addition to, or in place of, the rivets. However, these alternative methods are often more complex and expensive, while also sometimes being less dependable.

Prior art handles for folding knives have also been formed as a single unit, and the metal components are then installed. These one-piece handles may be formed by injection molding or other means, and they incorporate both the right and left sides of the handle. A spring holder is integrally formed at the rear end of the handle, connecting the two sides of the handle. An opening for receiving a leaf spring is located in the spring holder. Also, an open slot is provided between the two sides of the handle for inserting a rocker and a knife blade.

The assembly process for these one-piece handles consists of first placing a leaf spring rod into the spring-receiving opening in the spring holder. Next, a rocker is inserted into the slot between the handle halves. The pivot hole in the rocker is aligned with rivet holes through the handle sides, and a rocker rivet is inserted for retaining the rocker arm. The rear end of the rocker is then depressed, making contact with the spring, and providing room in the front of the handle to insert the base of the blade. The base of the blade, with a bushing in the blade pivot hole, is then inserted into the front of the handle and aligned with the blade rivet holes in the sides of the handle. A blade rivet is then inserted through the bushing and the blade rivet holes, and the knife is then completely assembled.

Because of their integral construction, the one-piece handles eliminate the necessity of providing a separate spring holder. They also eliminate the assembly steps of installing the spring holder and rivetting the handle at the spring holder. Thus, the one piece handles reduce the number of parts required, while also simplifying and speeding up the assembly process.

However, while the one-piece handles are easy to assemble into a knife, they have several disadvantages. Most importantly, the rear of the handle which includes the spring holder is a relatively thick section that connects the relatively thin left and right handle sides. This thick section cools unevenly and slowly during the injection molding cycle, and this, in turn, requires that the injection molding equipment be run at a very slow rate. This slow and uneven cooling can also lead to substandard parts being produced, and the associated waste of materials, time, and resources. Furthermore, molding of the one-piece design results in a large gate blemish on the exterior of the handle. Because the blemish is on the exterior of the handle, an additional operation is required to remove the blemish.

It will be apparent that a need exists for an inexpensive and easily assembled folding knife handle having a simple design. It is desirable to have the advantages of the prior art one-piece molded handle without the disadvantages of the slow-cooling, thick rear molded section. In addition, it is desirable to produce a handle which does not require the secondary operation necessary for removing the gate blemish from the one-piece handles. There is also a need for a two-piece handle for a folding knife which overcomes the limitations of the prior art two-piece handles, which requires fewer parts, and which is more quickly and easily assembled. The two-piece handle in accordance with the present invention overcomes the limitations of the prior handles, and provides a significant advance in the art.

SUMMARY OF THE INVENTION

It is an object of the present invention to provide a two-piece handle for a folding knife or similar tool.

Another object of the present invention is to provide a two-piece handle which is more easily assembled than the prior art two-piece handles.

An additional object of the present invention is to provide a two-piece handle which may be assembled to emulate the prior art one-piece handles.

A further object of the present invention is to provide a two-piece handle which, when formed by molding, may have the gates located on an internal surface of each handle half so that a secondary operation is not required for removal of any gate blemishes.

Yet another object of the present invention is to provide a two-piece handle which, when assembled, is held together at least in part by a rod which also serves as a leaf spring for the blade locking mechanism.

A further object of the present invention is to provide a two-piece handle which has a projection on one handle half which interfits with a recess in the other handle half, and wherein the projection is retained in the recess at least in part by a leaf spring rod.

As will be discussed in detail in the description of the preferred embodiment which is set forth subsequently, the two-piece handle in accordance with the present invention has a male half and a female half, each of which is formed separately by molding, casting, machining, or other processes. The male handle half includes a projection near the rear of the handle, and has a first hole in the projection for receiving a leaf spring rod. The female handle half has an integral spring receiving area having a recess for receiving the projection of the male handle half. The female handle half has a second hole in the spring receiving area for also receiving the leaf spring rod, and the second hole is located to intersect with the recess. When the projection of the male half is inserted into the recess of the female handle half, the first spring receiving hole in the projection and the second spring receiving hole in the female handle half line up sufficiently to enable the insertion of the leaf spring rod. When the leaf spring rod has been inserted, it retains the male handle half in an assembled state with the female handle half, while also providing a spring bias to the blade locking mechanism.

In addition, a rocker may be simultaneously installed between the handle halves when they are being assembled. This is accomplished by a rocker pin which is sandwiched within matching holes in the male and female handle halves. This eliminates the necessity of a rocker rivet, so that the assembled knife is preferably held together by only the leaf spring rod at the rear of the handle, and a blade rivet through the blade pivot hole toward the front of the handle.

The two-piece handle in accordance with the present invention overcomes the limitations of the prior two-piece knife handles by reducing the number of parts required for assembly, and also by simplifying the assembly process. The two-piece handle in accordance with the present invention also overcomes the molding limitations of the prior one-piece knife handles by elimination the thick rear spring receiving section. Furthermore, the two-piece handle in accordance with the present invention eliminates the need for a secondary operation to remove gate blemishes since the gates may be located on the interior surfaces of the handle halves. With the gates located on the interior surfaces, any gate remnants are not visible after the handle has been assembled, or, in the alternative, if a gate is located on an exterior surface, it would be small enough so as not to require a secondary operation to remove a gated blemish. An additional benefit of the present invention is the precise fit of the leaf spring in the spring receiving holes. The precision placement of the leaf spring rod has been shown in actual cycle testing to significantly extend the life of the locking mechanism. Thus, it is evident that the handle and method of assembly of the present invention provide a substantial advance in the art.

BRIEF DESCRIPTION OF THE DRAWINGS

While the novel features of the method and apparatus in accordance with the present invention are set forth with particularity in the appended claims, a full and complete understanding of the invention may be had by referring to the detailed description of the preferred embodiment which is set forth subsequently, and as illustrated in the accompanying drawings in which:

DESCRIPTION OF THE PREFERRED EMBODIMENT

Figure 1:
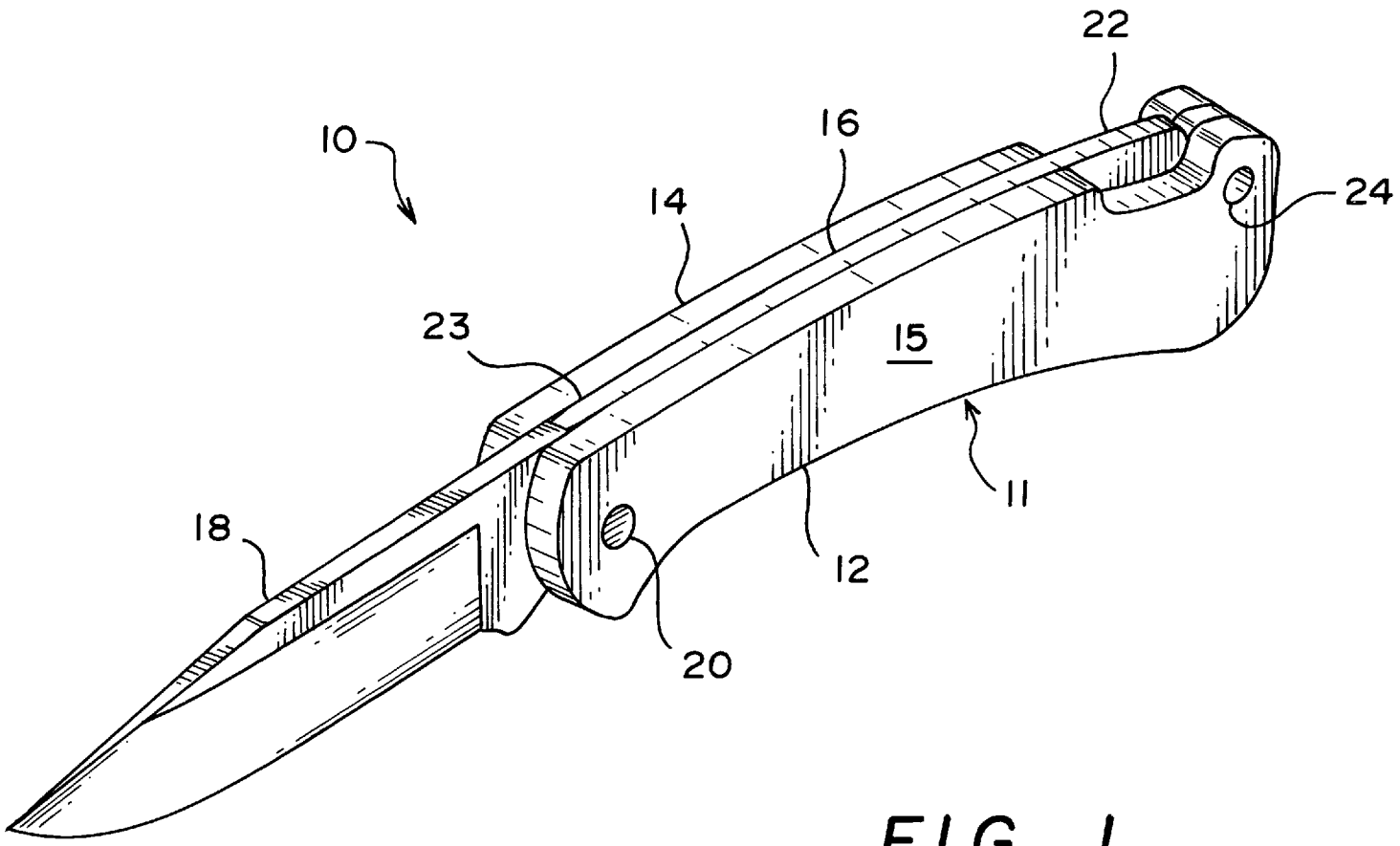
FIG. 1 is a perspective view of a folding knife having a two-piece handle constructed in accordance with the present invention, showing the knife blade in the open position.

Referring initially to FIG. 1, there is illustrated generally at 10 a perspective view of a preferred embodiment of a folding knife having a handle 11 constructed in accordance with the present invention. Knife 10 includes a male handle half 12, a female handle half 14, a rocker 16, and a blade 18. A rivet 20 passes through handle halves 12, 14, and through blade 18, holding together the forward end of knife 10. Blade 18 may be rotated about rivet 20 for opening and closing blade 18. Rivet 20 is preferably the only rivet used in the construction of knife 10.

FIG. 1 shows blade 18 locked in the open position. A rocker rear end 22 of rocker 16 may be depressed, which raises rocker forward end 23 for releasing blade 18 so that blade 18 may be rotated to a closed position (not shown). A lanyard hole 24 is formed through the rear of handle 11 for attaching a lanyard, keychain, or the like.

As illustrated in FIGS. 3–6, male handle half 12 has an interior surface 13 and an exterior surface 15. Female handle half 14 has an interior surface 17 and an exterior surface 19. When handle halves 12, 14 are assembled, interior surfaces 13, 17 face each other, while exterior surfaces 15, 19 serve as the exterior of the handle. Exterior surfaces 15, 19 may include various patterns, designs, inlays, or other ornamentation or grip improving features, as is known in the art.

Figure 2:
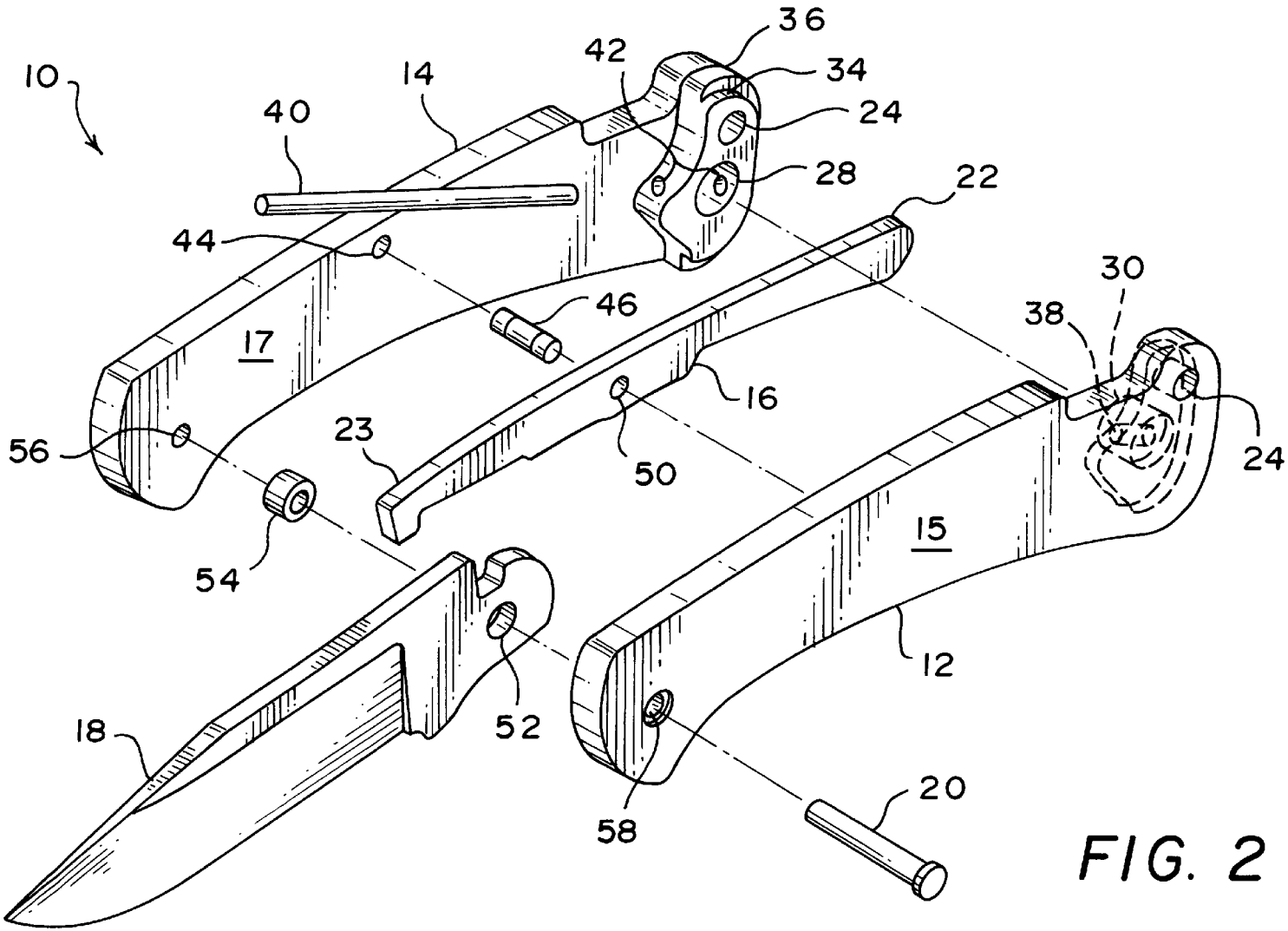
FIG. 2 is an exploded view of the knife and handle of FIG. 1.

As illustrated in FIG. 2, female handle half is formed with a thicker rear area on interior surface 17 which serves as an integral spring holder 26. Spring holder 26 has a generally cylindrical recess 28 formed in it. Male handle half 12 is formed with a generally cylindrical projection 30 on interior surface 13. Projection 30 is sized to be inserted into recess 28 when handle halves 12, 14 are assembled. Projection 30 and recess 28 are shown as cylindrical in the preferred embodiment, but may be formed in any suitable shape, so long as projection 30 is able to be inserted into recess 28.

Male handle half 12 may also have a generally kidney-shaped cavity 32 on interior surface 13 for receiving a matching generally kidney-shaped protruding portion 34 of spring holder 26 when handle halves 12, 14 are assembled. Protruding portion 34 and cavity 32 are designed to interfit with each other when projection 30 is inserted into recess 28, and they serve to help properly orient handle halves 12, 14, while also increasing the strength of the assembly. Protruding portion 34 and cavity 32 are not essential, and may be eliminated if desired. However, the generally kidney-shaped protruding portion 34 is preferred, as it, along with generally kidney-shaped spring holder 26, provides an extended bearing surface 35 which provides support for a spring rod during bending. In addition, if, for example, recess 28 and projection 30 are formed with a square shape, then the shape of recess 28 and projection 30 would properly orient handle halves 12, 14. Alternatively, an additional projection and recess (not shown) could be provided for properly orienting the handle halves, or other means could also be used.

Handle halves 12, 14 may be molded, such as by injection molding, or they may be machined, cast, forged, carved, or otherwise formed by any suitable method, and they may be made from polymers, metal, wood, or other suitable materials. If handle halves 12, 14 are molded, the molding gates may be advantageously located on interior surfaces 13, 17 so that any gate blemishes are not visible after the handle halves have been assembled. If any external gates are required, they can be made relatively small and unobtrusive so that secondary processing is not necessary.

Figures 3, 4, 5, 6, 7:
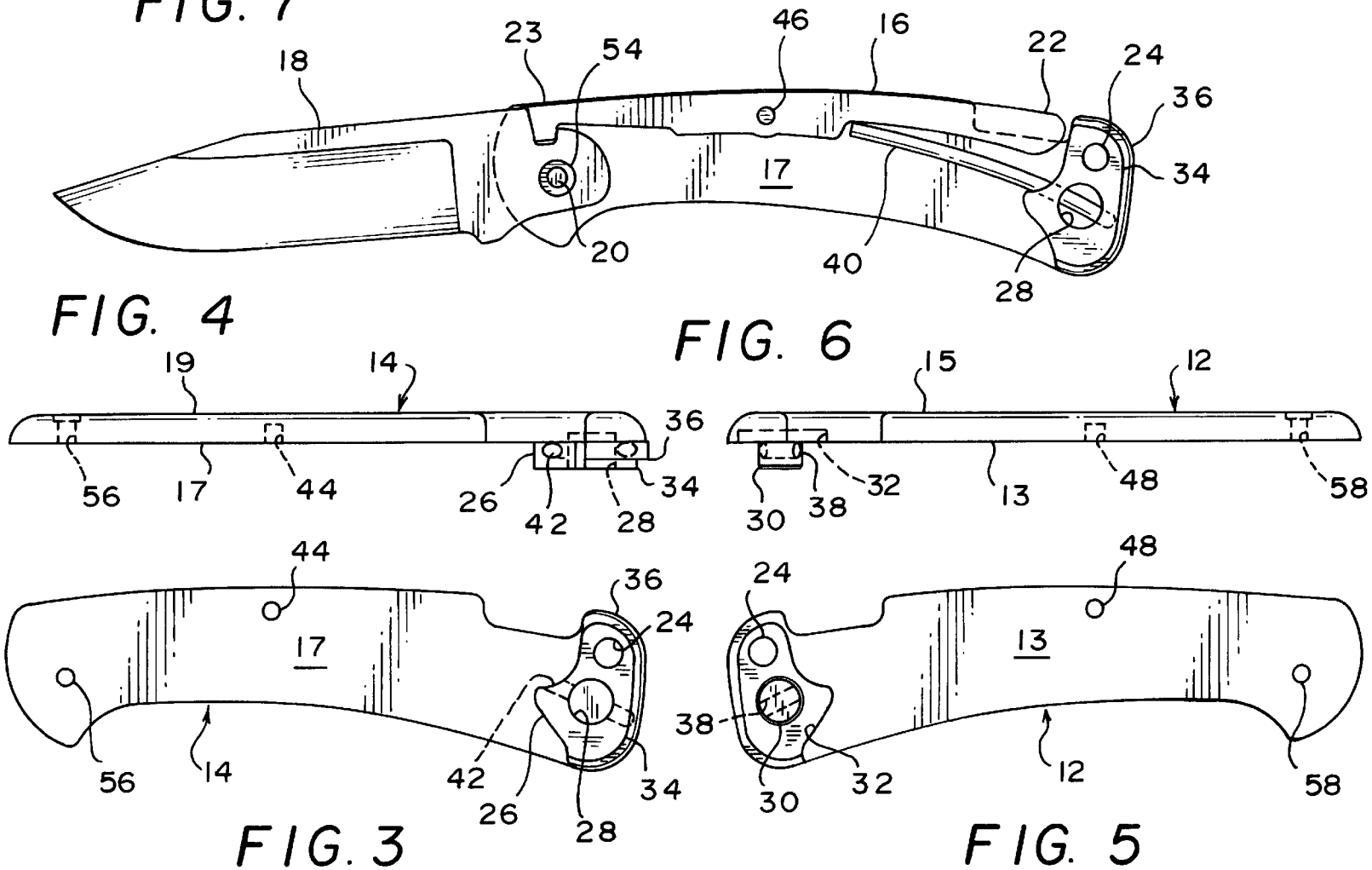
FIG. 3 is a side elevation view of a female handle half.
FIG. 4 is a top view of the female handle half of FIG. 3.
FIG. 5 is a side elevation view of a male handle half.
FIG. 6 is a top view of the male handle half of FIG. 5.
FIG. 7 is a side elevation view of the knife of FIG. 1, with the male handle half deleted to show the inner assembly of the knife.

As illustrated in FIGS. 3 and 4, spring holder 26 may be formed as raised slightly on its exposed edge 36 to visually simulate the separate spring holder found on a conventional knife. In addition, while it is preferred that spring holder 26 be integrally formed with female handle half 14, it is within the scope of the invention to form spring holder 26 separately, and attach it to female handle half 14 prior to assembly of female handle half 14 to male handle half 12.

As illustrated in FIGS. 5 and 6, projection 30 on male handle half 12 has a first spring receiving hole 38 for receiving a leaf spring rod 40, which is used to bias rear end 22 of rocker 16. A second spring receiving hole 42 is formed in spring holder 26 on female handle half 14 for also receiving leaf spring rod 40. As illustrated in FIGS. 3 and 4, second spring receiving hole 42 intersects with recess 28. When handle halves 12, 14 are assembled, projection 30 is inserted into recess 28, and second spring receiving hole 42 lines up with first spring receiving hole 38. Spring rod 40 may then be inserted into the aligned spring receiving holes 38, 42 for retaining handle halves 12, 14 in the assembled state. During insertion, it may be seen that spring rod 40 enters spring receiving hole 42 first, then passes through spring receiving hole 38, and extends into, and bottoms out in, the second half of spring receiving hole 42.

In the preferred embodiment of the invention, spring receiving holes 38, 42 are slightly misaligned when handle halves 12, 14 are assembled prior to insertion of spring rod 40. Then, when spring rod 40 is inserted into spring receiving holes 38, 42, the holes are forcibly brought into alignment, causing an interference fit which retains spring rod 40 in spring receiving holes 38, 42. This also causes handle halves 12, 14 to be tightly assembled. Of course, alternative methods of retaining spring rod 40 within spring receiving holes 38, 42 may be used, such as, for example, adhesive bonding, interference fit with only one of the spring receiving holes, or other suitable means. Also, an interference fit between recess 28 and projection 30 may be used to aid in retaining the handle halves in an assembled state in addition to spring rod 40. In addition, the shapes of spring receiving holes 38, 42 do not have to match the shape of spring rod 40. For example, a square or hexagonal spring rod may be used in a round hole, or other combinations may also be used. Alternatively, one or both of the spring receiving holes may be formed as slots, so long as spring rod 40 is firmly held when the handle halves are assembled.

Female handle half 14 also includes a first rocker pin hole 44 for receiving the first end of a rocker pin 46. A matching second rocker pin hole 48 is located in male handle half 12 for receiving the second end of rocker pin 46. As illustrated in FIGS. 4 and 6, rocker pin holes 44, 48 preferably do not penetrate completely through the walls of handle halves 12, 14, so that rocker pin 46 is clamped between handle halves 12, 14 when they are assembled, and rocker pin 46 is retained within rocker pin holes 44, 48. A rocker pivot hole 50 is formed near the midpoint of rocker 16 for enabling rocker 16 to be pivotally mounted on rocker pin 46. When a first end of rocker pin 46 is inserted into one of rocker pin holes 44, 48 on one of handle halves 12, 14, then rocker 16 may be mounted upon rocker pin 46 by pivot hole 50. The opposing handle half 12, 14 may then receive the second end of rocker pin 40 in the second rocker pin hole 44, 48 when handle halves 12, 14 are assembled. This results in rocker 16 being pivotally mounted on rocker pin 46, and sandwiched between handle halves 12, 14. Rocker pin 46 is of such a length that sufficient clearance will remain between handle halves 12, 14 to allow rocker 16 to pivot when handle halves 12, 14 are assembled. Alternatively, rocker pin holes 44, 48 may penetrate completely through handle halves 12, 14, and a conventional rivet may be used in place of rocker pin 46. Or, instead of a rivet, a pin having oversized or knurled ends may be press-fitted into the through holes.

To assemble knife 10, a male handle half 12 and a female handle half 14 in accordance with the present invention are first provided. A first end of rocker pin 46 is placed in one of rocker pin holes 44, 48 on one of handle halves 12, 14. Rocker 16 is mounted on rocker pin 46 through rocker pivot hole 50. Projection 30 on male handle half 12 is inserted into recess 28 on female handle half 14, while simultaneously, protruding portion 34 on female handle half 14 interfits into cavity 32 on male handle half 12. The second end of rocker pin 48 is generally simultaneously inserted into the second rocker pin hole 44, 48 on the opposing handle half 12, 14.

Spring receiving holes 38, 42 should now be almost in line, but sufficiently misaligned to form an interference fit when spring rod 40 is inserted. In addition, rocker 16 is at this point sandwiched between handle halves 12, 14, and capable of pivoting about rocker pin 46. To insert spring rod 40, rocker rear end 22 is rotated up approximately perpendicular to handle halves 12, 14, to give access to spring receiving holes 38, 42. Spring rod 40 is then inserted into spring receiving holes 38, 42, which draws spring receiving holes 38, 42 into alignment, and forces handle halves 12, 14 tightly together.

Blade 18 has a bushing receiving hole 52 for receiving a bushing 54, as is known in the art. Rocker rear end 22 is depressed, raising rocker forward end 23. Blade 18, with bushing 54 inserted, is then slid between handle halves 12, 14. The hole through bushing 54 is aligned with rivet holes 56, 58 in handle halves 12, 14, and rivet 20 is then inserted through rivet holes 56, 58, and bushing 54, for retaining blade 18. A head is then formed on rivet 20, and assembly of knife 10 is complete.

While a preferred embodiment of the subject invention has been described in the environment of a handle for a folding knife, it will be recognized that numerous other tools may be substituted for the knife blade of the preferred embodiment. For example, a screw driver blade, a corkscrew, a bottle opener, or any number of other tools may be substituted for knife blade 18, with the shape and configuration of handle 11 being suitably modified for the intended use. Also, while a locking knife blade has been described, the present invention may be used with other types of rocker and blade configurations, such as a knife in which a cammed blade base is used to bias the knife in the open position as well as the closed position.

In addition, while a preferred embodiment of a two-piece handle and method of assembly in accordance with the present invention has been set forth fully and completely hereinabove, it will be apparent to one of skill in the art that a number of other changes may be made in, for example, the shape and appearance of the handle halves, the size and location of particular components, and the like, without departing from the true spirit and scope of the present invention which is accordingly to be limited only by the following claims.

What is claimed is:

1. A two-piece handle comprising:

a first handle half having a projection, said projection having a first hole therein for receiving a spring rod; and a second handle half having a recess for receiving said projection of said first handle half, said recess being formed in a generally kidney-shaped spring holding portion, said second handle half having a second hole formed in said generally kidney-shaped spring holding portion and intersecting with said recess for receiving a spring rod, said spring holding portion further providing an extended bearing surface adjacent said second hole for supporting said spring rod during bending, wherein when said projection is inserted into said recess, said first hole and said second hole line up sufficiently to enable the insertion of a spring rod for aiding in retaining said first handle half in an assembled state with said second handle half.

2. The two-piece handle according to claim 1 wherein when said projection is fitted into said recess, said first hole and said second hole are aligned for receiving said spring rod by an interference fit for retaining said spring rod when said spring rod is inserted into said first hole and said second hole.

3. The two-piece handle according to claim 1 wherein when said projection is fitted into said recess, a generally kidney-shaped protruding portion formed on said generally kidney-shaped spring holding portion interfits with a generally kidney-shaped cavity on said first handle half for properly orienting said handles for insertion of a spring rod into said first and second holes.

4. The two-piece handle according to claim 1 wherein said projection and said recess form an interference fit when said projection is inserted into said recess.

5. The two-piece handle according to claim 1 wherein said first handle half and said second handle half further include opposing rocker pin receiving holes for receiving a rocker pin, said rocker pin receiving holes not penetrating completely through said handle halves.

6. The two-piece handle according to claim 1 in which a lanyard hole is formed in said first handle half and said second handle half.

7. A method of assembling a two-piece handle for a knife, said method comprising:

providing a first handle half having a first spring-receiving hole therein for receiving a spring rod;

providing a second handle half have having a second spring-receiving hole therein for receiving a spring rod;

providing opposed rocker pin holes in said first handle half and said second handle half, said rocker pin holes not penetrating completely through said handle halves;

inserting a first end of a rocker pin into one of said rocker pin holes;

mounting a rocker on said rocker pin;

inserting a second end of said rocker pin into said second rocker pin hole for retaining said rocker pin between said first handle half and said second handle half when said handle halves are assembled, so that said rocker is pivotally mounted between said first and second handle halves;

assembling said first handle half to said second handle half whereby said first spring-receiving hole and said second spring-receiving hole are at least partially aligned;

inserting a spring rod into said first spring-receiving hole and said second spring-receiving hole for at least partially maintaining said handle halves in an assembled state;

inserting a blade having a pivot hole between said first and said second handle halves;

aligning said pivot hole with a first rivet hole located on said first handle half and with a second rivet hole located on said second handle half;

inserting a rivet through said first rivet hole, said pivot hole and said second rivet hole; and forming a head upon said rivet.

8. The method of claim 7 in which said first handle half and said second handle half are formed by injection molding.

* * * * *